United States Patent [19]

Shimoma et al.

[11] Patent Number: 4,845,401

[45] Date of Patent: Jul. 4, 1989

[54] COLOR CATHODE RAY TUBE WITH DEFLECTION MEANS

[75] Inventors: Taketoshi Shimoma, Isesaki; Kumio Fukuda, Hyogo, both of Japan

[73] Assignee: Kabushiki Kaisha Toshiba, Kawasaki, Japan

[21] Appl. No.: 157,130

[22] Filed: Feb. 10, 1988

Related U.S. Application Data

[63] Continuation of Ser. No. 876,745, Jun. 20, 1986, abandoned.

[30] Foreign Application Priority Data

Jun. 21, 1985 [JP] Japan ..... 60-133963
Jun. 21, 1985 [JP] Japan ..... 60-133966

[51] Int. Cl.[4] ..... H01J 29/72
[52] U.S. Cl. ..... 313/413; 313/440
[58] Field of Search ..... 313/412, 413, 421, 431, 313/433, 440, 434, 437; 335/210, 213

[56] References Cited

U.S. PATENT DOCUMENTS 3,800,176 3/1974 Gross et al. ..... 313/69
4,415,831 11/1983 Konosu ..... 313/431 X
4,433,268 2/1984 Arisato ..... 313/440

FOREIGN PATENT DOCUMENTS 2824881 1/1979 Fed. Rep. of Germany .
2903539 8/1979 Fed. Rep. of Germany .
2937871 4/1980 Fed. Rep. of Germany .
57-145254 3/1982 Japan ..... 313/412

*Primary Examiner*—Kenneth Wieder
*Attorney, Agent, or Firm*—Cushman, Darby & Cushman

[57] ABSTRACT

In a color cathode ray tube, an in-line electron gun assembly is located in the neck of a vacuum envelope and vertical and horizontal magnetic coils are arranged on the outer surface of the funnel of the vacuum envelope. The vertical magnetic coil produces a vertical magnetic field which has an asymmetrical distribution relative to a horizontal axis within a deflection plane. The asymmetrical distribution is determined as a function of the screen position on which electron beams deflected from the horizontal axis of the screen land. The electron beams are thus subjected to a negative astigmatism by the vertical deflection magnetic field.

12 Claims, 3 Drawing Sheets

COLOR CATHODE RAY TUBE WITH DEFLECTION MEANS

This is a continuation of application Ser. No. 876,745, filed June 20, 1986, now abandoned, which was abandoned upon the filing hereof.

BACKGROUND OF THE INVENTION

The present invention relates to an in-line type color cathode ray tube and, more particularly, to an improved in-line type color cathode ray tube having deflection yokes for generating an improved magnetic field distribution within a deflection plane.

A vacuum envelope in a conventional color cathode ray tube includes a neck received in an electron gun assembly of in-line type, a panel having a faceplate on which a screen, such as a phosphor screen is formed, and a funnel for coupling the neck to the faceplate.

The electron gun assembly includes three electron guns which are horizontally arranged. Electron beams emitted from these electron guns land on a phosphor screen which has red, green, and blue phosphor stripe layers and formed on the faceplate. Thus, a light ray is emitted from these phosphor layers. In this case, the electron beams are selectively landed on predetermined phosphor stripe layers to emit light with adequate color reproduction. For this purpose, a shadow mask with a large number of apertures is arranged in the panel and opposes the faceplate.

The in-line type electron guns are designed such that three electron beams emitted from cathodes thereof always pass through a common plane and are converted near a screen. U.S. Pat. No. 2,957,106 describes a three-electron beam converging technique wherein the center beam and side beams inclined in respect to the center beam, are emitted from the corresponding cathodes. U.S. Pat. No. 3,772,554 describes an electron beam converging technique wherein side beam apertures of some of the electrodes constituting an electron lens are deviated outward in comparison with the side beam apertures of the other electrodes. These conventional techniques have been in popular use for conventional color cathode ray tubes.

An electron beam deflection device is mounted on the outer surface of a conical portion of the funnel to scan the phosphor screen with the electron beams from the electron guns. The electron beam deflection device has a horizontal deflection coil for generating a horizontal deflection magnetic field to horizontally deflect the electron beams, and a vertical deflection coil for generating a vertical deflection magnetic field to vertically deflect the electron beams. In an actual color cathode ray tube, convergence errors may occur when three beams are deflected. In order to eliminate these errors, a technical countermeasure is provided in conventional color cathode ray tubes. This countermeasure is the use of a so-called convergence-free system. According to the conventional technique, the horizontal deflection magnetic field is of a pincushion type, and the vertical deflection magnetic field is of a barrel type. With this countermeasure, the three electron beams are focused on the entire surface of the phosphor screen. Therefore, in the color cathode ray tube employing a convergence-free system, a parabolic current generator for convergence correction and a convergence yoke for generating a convergence correction magnetic field can be omitted. The color cathode ray tube can thus be fabricated at low cost and its productivity can be improved.

Various techniques are adopted in color cathode ray tubes to improve image quality, as described above. However, an increase in screen size of cathode ray tubes poses new problems.

Electron beams respectively emitted from three electron guns are landed on the phosphor screen to form an electron beam spot. An electron beam spot consisting of only a circular core is formed at the central portion of the screen receiving electron beams without deflection. However, an electron beam spot consisting of a flat core and upper and lower flares is formed at a screen corner on which deflected electron beams are directed. As a result, the size of the electron beam spot at the screen corner is increased to degrade focusing and hence, resolution.

SUMMARY OF THE INVENTION

It is an object of the present invention to provide a color cathode ray tube wherein distortion of an electron beam spot at a screen corner is reduced and an image with high resolution and a high brightness level on the entire screen can be obtained.

In order to achieve the above object of the present invention, there is provided a color cathode ray tube, comprising:

- a vacuum envelope including a panel section, a funnel section and a neck section, the panel section including a faceplate having an inner surface;
- a phosphor screen formed on the inner surface of the faceplate and having horizontal and vertical axes;
- an electron gun assembly of an in-line type which includes three electron guns and is received in the neck section, for emitting electron beams to be landed on the phosphor screen;
- a shadow mask arranged in the panel section to oppose the phosphor screen and having a large number of apertures for allowing passage of electron beams therethrough; and
- deflecting means arranged on an outer surface of the funnel section and defining a deflection plane therein, for generating a horizontal deflection magnetic field for horizontally deflecting the electron beams and a vertical deflection magnetic field for vertically deflecting the electron beams, the vertical deflection magnetic field having an asymmetrical magnetic field distribution with respect to a horizontal axis within the deflection plane, the asymmetrical magnetic field distribution being determined as a function of a screen position on which the electron beams deflected from the horizontal axis on the screen are landed, and the electron beams being subjected to negative astigmatism by the vertical deflection magnetic field.

DETAILED DESCRIPTION OF THE PREFERRED EMBODIMENTS

Figure 1:
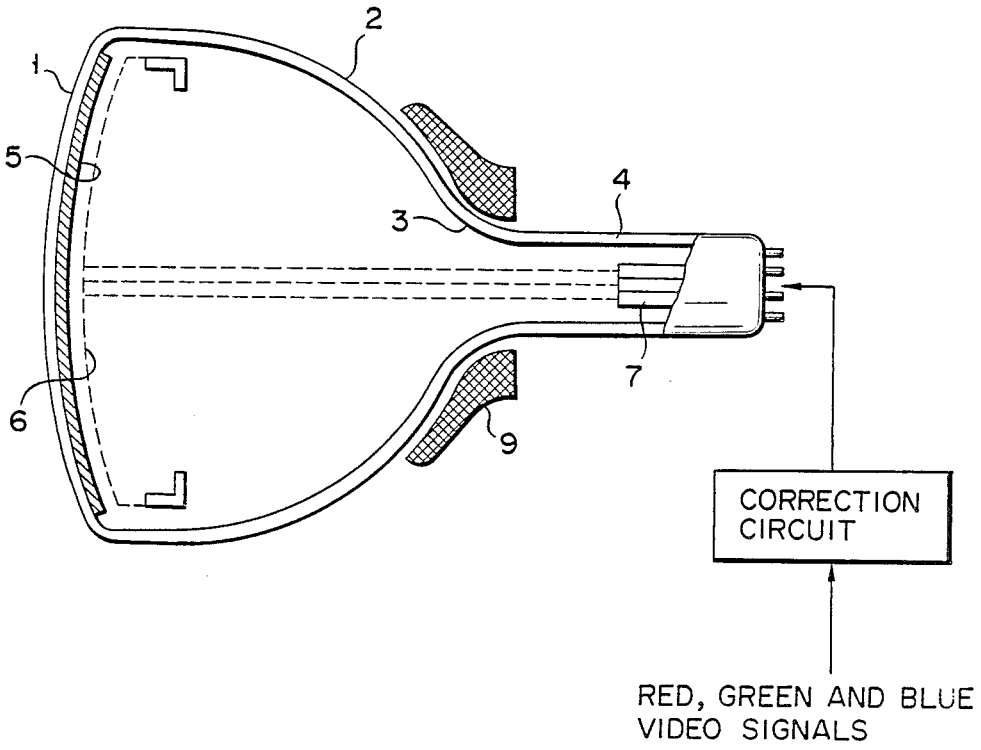
FIG. 1 is a schematic sectional view of a color cathode ray tube according to an embodiment of the present invention.

FIG. 1 is a sectional view schematically showing a 20", 90 degree color cathode ray tube according to an embodiment of the present invention. In the cathode ray tube, funnel 2 is coupled to the skirt of panel 1. Neck 4 is coupled to the funnel 2 to form a vacuum envelope. Red, green, and blue phosphor stripes or dots are regularly arranged on the inner surface of the faceplate of panel 1 to constitute screen 5 for displaying an image. Shadow mask 6 opposes screen 5 and is supported on the inner surface of the panel. Shadow mask 6 is made of a thin iron plate, the front surface of which has a dome-like shape similar to the shape of the inner surface of the faceplate. A large number of apertures 6-1 are formed in mask 6 to transmit electron beams therethrough, so as to allow the beams to properly land on the phosphor screen.

In-line type electron gun assembly 7 is accommodated in neck 4. Gun assembly 7 has three in-line type electron guns for generating three electron beams which respectively land on the corresponding red, green, and blue phosphor stripes. The electron guns are horizontally arranged, and the electron beams are emitted therefrom in horizontal plane accordingly. A distance between each two adjacent electron beams is 6.6 mm. As is well known, each electron gun comprises a cathode control electrode for generating an electron beam, a shielding electrode, a focusing electrode, and a high-voltage electrode. Predetermined voltages are applied to these electrodes. More specifically, for example, a very high voltage of 25 kV is applied to the high-voltage electrode so that the color tube is maintained at a voltage of about 25 kV.

A funnel connecting portion at which funnel 2 is connected to neck 4 is called cone 3. Deflection device 9 is mounted on cone 3. Deflection device 9 includes a horizontal deflection coil for generating a magnetic field for horizontally deflecting parallel electron beams propagating toward the deflection plane, and a vertical deflection coil for vertically deflecting the electron beams.

Figure 2:
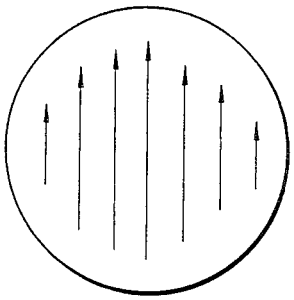
FIG. 2 is a plan view showing a horizontal deflection magnetic field on a deflection plane of a deflection device in FIG. 1.
Figure 3A:
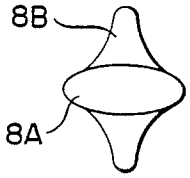
FIG. 3A (PRIOR ART)
FIG. 3A is a plan view of a beam spot at a peripheral portion of a screen, the beam spot being formed by electron beams deflected by the conventional horizontal deflection magnetic field of a pincushion type on the deflection plane.
Figure 3B:
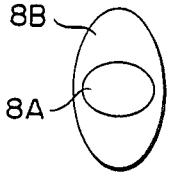
FIGS. 3B and 3C are plan views of beam spots at peripheral portions of the screen, the beam spots being formed by electron beams deflected by the horizontal deflection magnetic field shown in FIG. 2.
Figure 3C:
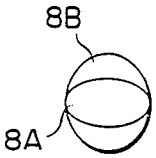

According to the first embodiment of the present invention, a uniform magnetic field in FIG. 2 is employed as the horizontal deflection magnetic field generated by the horizontal deflection coil. The "uniform magnetic field" here means that a magnetic field acting on the electron beams has an astigmatism of substantially zero. Therefore, the shape of the electron beam spot formed on phosphor screen 5 by horizontally deflected electron beams can be greatly improved. In a conventional horizontal deflection coil, a magnetic field is of a pin-cushion type. With a pincushion magnetic field, a beam spot consisting of only circular core 8A is formed at the central portion of the screen. An electron beam spot consisting of core 8A deformed to a flat ellipse (FIG. 3A) and long flares 8B extending from core 8A is formed at a peripheral portions of the screen, especially the screen corners. The beam spot formed at a screen corner, as shown in FIG. 3A, is larger than the beam spot of core 8A formed at the central portion of the screen since core 8A is deformed to be a flat ellipse and long flares 8B extend from core 8A, thereby degrading the resolution of an image at the screen corner. On the other hand, according to the above embodiment, since the uniform magnetic field is employed, the beam spot formed at the screen corner consists of slightly deformed eliptical core 8A and short flares 8B extending from this core, as shown in FIG. 3B. The size of this beam spot is not greatly increased, compared to the beam spot consisting of only circular core 8A formed at the central portion of the screen. As a result, degradation of the resolution of the image at the screen corner can be prevented. The beam spot in FIG. 3B is obtained when a focal length of the electron lens of the electron gun is aligned with the center of the screen. However, if the focal length of the electron lens of the electron gun is aligned with a peripheral portion of the screen, deformation of core 8A is further reduced, as shown in FIG. 3C. In addition, deformation of flares 8B extending from the core is also reduced. As a result, degradation of the resolution of the image at the screen corner or other peripheral portions can be further reduced.

Figure 5:
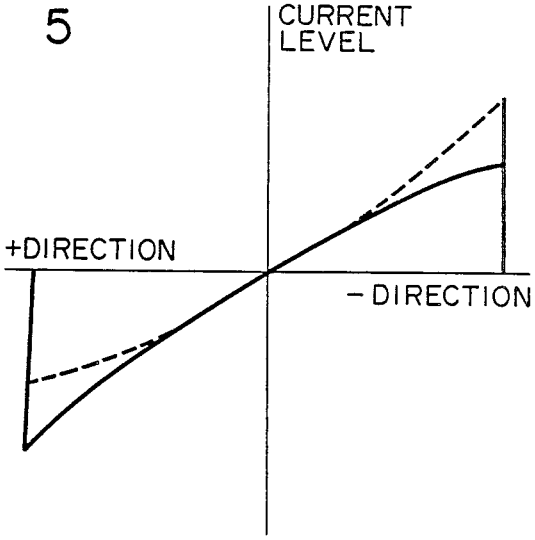
FIG. 5 is a graph showing the relationship between the deflection direction and the current levels supplied to the vertical deflection coil to form the vertical deflection magnetic fields shown in FIGS. 4A and 4B.

In the embodiment described above, the vertical deflection coil comprises troidal coil sections arranged above and below the cone. With this vertical deflection coil, a deflection magnetic field having a magnetic field distribution vertically asymmetrical about the horizontal axis is formed. If the electron beams are deflected upward (+ direction), a current having a lower level than that applied to the lower troidal coil section is supplied to the upper troidal coil section, as indicated by the broken line in FIG. 5. However, if the electron beams are deflected downward (− direction), a current having a lower level than that applied to the upper troidal coil section is supplied to the lower troidal coil section, as indicated by the solid line in FIG. 5. Thus, the direction of currents flowing through the upper and lower troidal coil sections are changed according to the deflection direction of the electron beams.

Figure 4A:
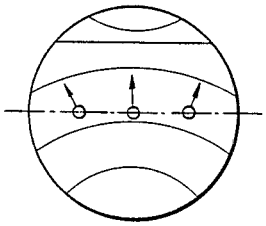
FIGS. 4A and 4B are plan views showing a vertical deflection magnetic field distribution on the deflection plane of the deflection device in FIG. 1.
Figure 4B:
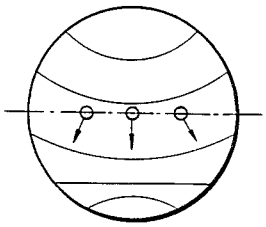

In this embodiment, since the deflection magnetic field having the magnetic field distribution vertically asymmetrical about the horizontal axis is formed by the vertical deflection coil, a deflection force from only the upper or lower vertical component (+ direction or − direction) acts on the center beam, as indicated by the vectors in FIGS. 4A and 4B. However, a deflection force including the outward vertical component and the horizontal component acts on the side beams adjacent to the center beam. Such a deflection force is increased when the deflection angle is increased. In other words, when a deflection distance, defined as a distance from the horizontal axis of the screen to the position at which the deflected electron beams land, is increased, the deflection force is increased. Therefore, negative astigmatism is effected for the electron beams. By adjusting the intensity of the vertically asymmetrical deflection magnetic field distribution, the force acting on the side beams can be adjusted. Distance Δ between the electron beams on the screen can therefore be kept constant along the vertical axis. An electron beam spot formed on the screen by the electron beams deflected by the nondeflection magnetic field can sufficiently decrease deflection distortion compared to the deflection distortion generated in the conventional apparatus. In the embodiment of the present invention, in the asymmetrical magnetic field, as shown in FIGS. 4A or 4B, a correction value of the distance between the side beams can be determined in accordance with the magnetic field intensity. The distortion in each electron beam depends on the magnetic field density distribution of the region through which the beam passes, i.e., the magnetic field intensity. In this embodiment, the distortion can be minimized since the magnetic field density distribution can be adjusted.

Figure 4C:
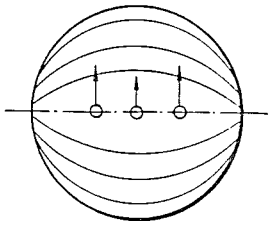
FIG. 4C (PRIOR ART)
FIG. 4C is a plan view showing a vertical deflection magnetic field distribution of barrel type formed on the deflection plane by a conventional vertical deflection coil.

According to the conventional deflection device, since the vertical magnetic field distribution symmetrical about the horizontal axis is formed, as shown in FIG. 4C, the distance between the side beams cannot be corrected if the respective electron beams are not deflected or slightly deflected. Distortion of the electron beams greatly varies since the magnetic flux densities greatly vary according to the regions through which the electron beams pass.

In the asymmetrical magnetic field shown in FIGS. 4A or 4B, the distance between the electron beams can be corrected even if the beam deflection distance is small or is zero. On the contrary, in the symmetrical magnetic field shown in FIG. 4C, the distance between the electron beams cannot be substantially corrected when the beam deflection distance is small or is zero. In addition, since the variations in magnetic flux density are large, a beam spot size is inevitably increased.

Figure 6:
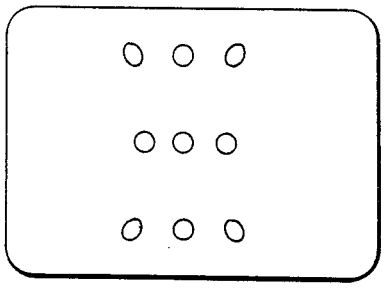
FIG. 6 is a plan view illustrating the beam shape on the screen in a color cathode ray tube adopting the vertically asymmetrical deflection magnetic field in FIG. 1.
Figure 7:
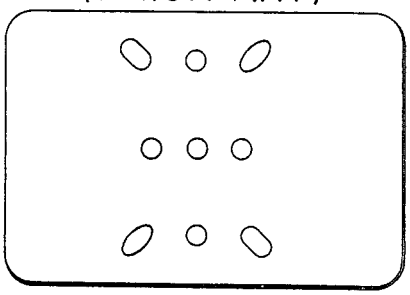
FIG. 7 (PRIOR ART)
FIG. 7 is a plan view illustrating a beam shape on the screen of a color cathode ray tube employing a conventional symmetrical deflection magnetic field.

FIG. 6 illustrates beam spot shapes on the screen of the color cathode ray tube employing the vertically asymmetrical deflection magnetic field according to the embodiment described above. FIG. 7 illustrates beam spot shapes on the screen of the color cathode ray tube employing the conventional symmetrical deflection magnetic field. As is apparent from comparison between the beam spot shapes in FIGS. 6 and 7, in the color cathode ray tube of the present invention, both side beam spot shapes are circular. In addition, inclination of the beam spots is small. As a result, although omitted in FIG. 6, the beam shape at the screen corners as well as at the upper and lower screen portions can be improved.

Figure 8:
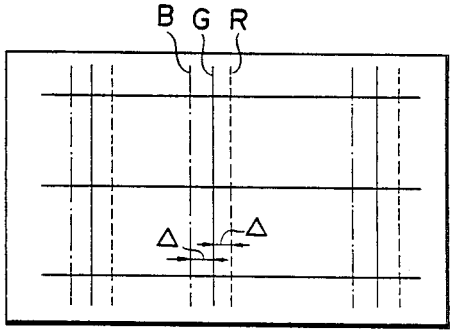
FIG. 8 is a plan view of a screen to explain beam spot error Δ produced when the vertical deflection magnetic field has the magnetic field distribution shown in FIGS. 4A or 4B; and the horizontal deflection magnetic field has the magnetic field distribution shown in FIG. 2.
Figure 9:
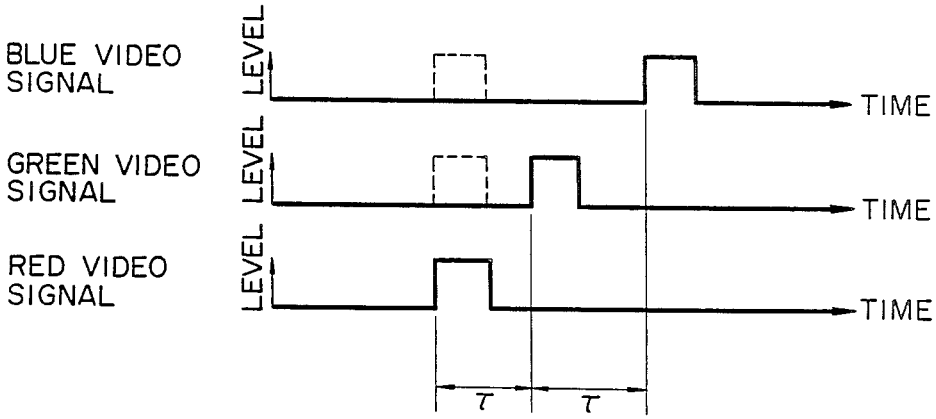
FIG. 9 is a timing chart of red, green, and blue video signals supplied to three electron guns.

In the color cathode ray tube according to the embodiment described above, red, green, and blue electron beams are separated by predetermined distance Δ throughout the screen, as shown in FIG. 8. If an image is displayed on the screen in this state, the red, green, and blue components are separated by predetermined distance Δ, thereby causing color misregistration. The misregistration can be corrected by delaying the signals applied to the electron guns by predetermined times. As a result, the red, green, and blue components can be completely registered. The color cathode ray tube according to the above embodiment shown in FIG. 1 further comprises correction circuit 10 for delaying the red, green, and blue video signals by predetermined times. The video signals are supplied to electron guns 7 at timings shown in FIG. 9.

In the conventional color cathode ray tube, red, green, and blue video signals are simultaneously supplied to the corresponding electron guns. In the color cathode ray tube according to this embodiment, a green video signal delayed by predetermined time Δ from the red video signal is supplied to the green electron gun. A blue video signal delayed by predetermined time Δ from the green video signal is supplied to the blue electron gun. Delay time is defined as follows:

$$\tau = C \times \Delta / (f \times H)$$

where H is the width of the screen, f is the horizontal deflection frequency, and C is the constant determined by over scanning or the like.

Another embodiment of the present invention will be described below. In the above embodiment, the electron gun assembly is designed to generate parallel electron beams with respect to the deflection plane. However, in the second embodiment, an electron gun is designed such that three electron beams emitted from cathodes of the electron guns are converged near a screen, as described in U.S. Pat. No. 2,957,106 or 3,772,554. This cathode ray tube employs the above-mentioned deflection device for generating an asymmetrical vertical deflection magnetic field and a pincushion magnetic field as a horizontal deflection magnetic field. The electron beams gradually come together near the screen while traveling within the tube. Therefore, the same asymmetrical magnetic field distribution pattern as in the color cathode ray tube using the electron gun assembly for generating parallel electron beams with respect to the deflection plane cannot be employed. The asymmetrical magnetic field distribution pattern must be corrected according to the focused electron beams. The deflection device then produces the asymmetrical magnetic field distribution of a proper pattern to provide negative astigmatism to the focused electron beams. As a result, a beam spot with a smallest distortion can be formed on the screen.

In the above embodiment, the vertical deflection coil itself generates the asymmetrical magnetic field. However, the vertical deflection coil itself may generate a symmetrical magnetic field and an auxiliary vertical deflection coil may be arranged. In this case, an auxiliary vertical deflection signal synchronized with the vertical deflection signal supplied to the vertical deflection coil is supplied to the auxiliary vertical deflection coil, and said auxiliary vertical coil generates an asymmetrical magnetic field in the symmetrical magnetic field produced by the vertical deflection coil.

What is claimed is:

1. A color cathode ray tube, comprising:

a vacuum envelope including a panel section, a funnel section and a neck section, said panel section including a faceplate having inner surface;

a phosphor screen formed on said inner surface of said faceplate and having horizontal and vertical axes;

an electron gun assembly of an in-line type which includes three electron guns and is received in said neck section, for emitting electron beams toward said phosphor screen;

a shadow mask arranged in said panel section to oppose said phosphor screen and having a large number of apertures for allowing passage of electron beams therethrough; and deflecting means arranged around said funnel section and defining a deflection plane therein, for generating a horizontal deflection magnetic field for horizontally deflecting the electron beams and a vertical deflection magnetic field for vertically deflecting the electron beams, the vertical deflection magnetic field having a vertically asymmetrical magnetic field distribution with respect to a horizontal axis within the deflection plane, said vertical deflection magnetic field having an upper component disposed above the horizontal axis, and a lower component disposed below the horizontal axis which is not equal to the upper component, said upper and lower components each being determined as function of a screen position on which the electron beams deflected from the horizontal axis on said screen land and the electron beams being subjected to a negative astigmatism by the vertical deflection magnetic field.

2. A tube according to claim 1, wherein the three electron beams are directed to be substantially parallel from said electron gun assembly toward the deflection plane.

3. A tube according to claim 2, wherein the horizontal deflection magnetic field has a uniform magnetic field distribution.

4. A tube according to claim 1, wherein the three electron beams are converged toward the screen from said electron gun assembly, through the deflection plane.

5. A tube according to claim 4, wherein the horizontal deflection magnetic field has a pincushion type magnetic field distribution.

6. A tube according to claim 1, wherein the vertical deflection magnetic field is a magnetic field having a composite magnetic field distribution including a main deflection magnetic field component having a magnetic field distribution symmetrical about the horizontal axis within the deflection plane, and an auxiliary deflection magnetic field component having a magnetic field distribution asymmetrical about the horizontal axis within the deflection plane.

7. A color cathode ray tube, comprising:

a vacuum envelope including a panel section, a funnel section and a neck section, said panel section including a faceplate having inner surface;

a phosphor screen having an upper region and a lower region formed on said inner surface of said faceplate and having horizontal and vertical axis;

an electron gun assembly of an in-line type which includes three electron guns and being disposed in said neck section, for emitting electron beams toward said phosphor screen;

a shadow mask arranged in said panel section to oppose said phosphor screen and having a large number of apertures for allowing passage of electron beams therethrough; and deflecting means arranged around said funnel section and defining a deflection plane therein, for generating a horizontal deflection magnetic field for horizontally deflecting the electron beams, a first vertical magnetic field for deflecting the electron beams while electron beams are directed to said upper region of said screen, and a second vertical magnetic field for deflecting the electron beams while electron beams are directed to said lower region of said screen, each of the first and second vertical magnetic fields having a vertical asymmetrical magnetic field distribution with respect to a horizontal axis within the deflection plane, the first and second vertical magnetic fields being mutually symmetrical with respect to a horizontal axis within the deflection plane, the electron beams being subjected to a negative astigmatism by each of the first and second vertical deflection magnetic fields.

8. A tube according to claim 7, wherein the three electron beams are directed to be substantially parallel from said electron gun assembly toward the deflection plane.

9. A tube according to claim 7, wherein the horizontal deflection magnetic field has a uniform magnetic field distribution.

10. A tube according to claim 7, wherein the three electrons beams are converged toward the screen from said electron gun assembly through the deflection plane.

11. A tube according to claim 10, wherein the horizontal deflection magnetic field has a pincushion type magnetic field distribution.

12. A tube according to claim 11, wherein the vertical deflection magnetic field is a magnetic field having a composite magnetic field distribution including a main deflection magnetic field component having a magnetic field distribution symmetrical about the horizontal axis within the deflection plane, and an auxiliary deflection magnetic field component having a magnetic field distribution asymmetrical about the horizontal axis within the deflection plane.

* * * * *